US006493532B2

(12) United States Patent
Nakahara et al.

(10) Patent No.: US 6,493,532 B2
(45) Date of Patent: Dec. 10, 2002

(54) SLIDE-ROTATING COLLAR PROTECTING ROTATABLE RESIN SHAFT

(75) Inventors: Tomotoshi Nakahara, Kanagawa (JP); Keishi Nishioka, Tokyo (JP); Toshiyuki Itoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/888,524

(22) Filed: Jun. 26, 2001

(65) Prior Publication Data

US 2002/0018671 A1 Feb. 14, 2002

(30) Foreign Application Priority Data

Jun. 26, 2000 (JP) ..... 2000-191170

(51) Int. Cl.[7] ..... G03G 15/08

(52) U.S. Cl. ..... 399/256; 29/525.01; 399/88; 399/90

(58) Field of Search ..... 399/256, 265, 399/279, 159, 116, 117, 88, 90, 262; 29/525.01

(56) References Cited

U.S. PATENT DOCUMENTS

| | | | | |
|---|---|---|---|---|
| 5,444,516 A | | 8/1995 | Michlin et al. | 399/1 |
| 5,541,029 A | | 7/1996 | Iwata et al. | 430/45 |
| 5,634,175 A | * | 5/1997 | Michlin et al. | 399/90 |
| 5,640,229 A | | 6/1997 | Nakahara | 399/119 |
| 5,784,669 A | | 7/1998 | Miura et al. | 399/58 |
| 5,822,652 A | * | 10/1998 | Elhatem et al. | 399/90 |
| 5,869,213 A | | 2/1999 | Iwata et al. | 430/45 |
| 5,915,155 A | | 6/1999 | Shoji et al. | 399/262 |
| 6,122,469 A | | 9/2000 | Miura et al. | 399/227 |
| 6,125,243 A | | 9/2000 | Shoji et al. | 399/29 |
| 6,151,465 A | * | 11/2000 | Toba et al. | 399/90 |

FOREIGN PATENT DOCUMENTS

| | | | |
|---|---|---|---|
| JP | 06102754 | | 4/1994 |
| JP | 08022195 | | 1/1996 |
| JP | 09-058896 | * | 3/1997 |
| JP | 10039665 | | 2/1998 |
| JP | 11-125266 | * | 5/1999 |

OTHER PUBLICATIONS

Patent Abstracts of Japan, JP 60–220222, Nov. 2, 1985.

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A slide-rotating collar integrally mounted on a resin shaft is configured to have a projected portion at one end of a metallic plate and a recessed portion at the other end thereof such that both ends engageably face each other without aligning in a shaft line direction. The shaft may be used in an electrostatic developing device in an image forming apparatus.

11 Claims, 4 Drawing Sheets

SLIDE-ROTATING COLLAR PROTECTING ROTATABLE RESIN SHAFT

BACKGROUND OF THE INVENTION

1. Field of the Invention

The present invention relates to a slide-rotating collar which protects a rotating resin shaft, a developing device using the slide-rotating collar and an image forming apparatus using the developing apparatus, and more particularly to a slide-rotating collar with a simple construction.

2. Discussion of the Background

An image forming apparatus, in which an electrostatic latent image is formed on a surface of an image bearing member, is commonly known. The electrostatic latent image is developed into a visible image with toner by a developing device. The visible image is then transferred onto a transfer sheet to obtain a recording image.

In the above-described developing device, a conveying screw is used to stir and convey a developer. In recent years, this conveying screw has been manufactured of an integrally molded resin to reduce weight and operational load.

The conveying screw includes a rotational shaft. A bearing provided in a non-moving member supports the shaft so that the shaft rotates. The shaft rotates, for example, at a high speed of 300 rpm.

Conventionally, either a metallic pipe is inserted into a mold and molded with the shaft, or the metallic pipe is press-fitted to the resin shaft after the shaft is molded, in order to prevent wear of the resin shaft caused by a friction between the resin shaft and a metallic bearing.

However, it is difficult to form a metallic pipe having a thin wall. The thicker the wall of the metallic pipe, the smaller the diameter of the resin shaft, resulting in a decrease in mechanical strength of the shaft.

A secondary process is required to thin the wall of the metal pipe, resulting in an additional processing cost. The driving load of the shaft is increased and apparatus using the resin shaft are increased in size, when the diameter of the shaft is increased.

SUMMARY OF THE INVENTION

The present invention has been made in view of the above-mentioned and other problems and addresses the above-discussed and other problems.

The present invention advantageously provides a novel slide-rotating collar with a simple construction and at a reduced cost. The slide-rotating collar protects the rotating shaft without causing an increased driving load and without resulting in increased size of apparatus using a resin shaft.

According to an embodiment of the present invention, a collar is provided for a rotating shaft. This collar protects the rotating shaft by covering it. Preferably, the collar covers the shaft such that a contact between a bearing and the shaft is avoided, i.e. only the collar but not the shaft contacts the bearing. Preferably, the collar is constituted to allow sliding contact between the collar and the shaft for mounting the collar on the shaft. The collar is preferably made of a bent metallic plate. This metallic plate may be for instance sheet metal, a formed plate (including e.g. stamped and/or cut projections or recesses), or a planar plate. The bent shape is preferably such that it covers at least a part of the circumference of the rotating surface of the rotating shaft. Preferably the bent shape is rotationally symmetric (e.g. cylindrically or conically). Preferably the covering is such that it covers a whole circumference of a shaft, or most of the circumference of the shaft, or at least those sections where the shaft would otherwise contact a bearing. Due to a bending of the plate, two ends of the plate which were at opposite ends before bending, are adjacent to each other. There may be a distance between the two ends which is small in comparison to the circumference of the surface to be covered (e.g. smaller than 10%, preferably smaller than 1% of the circumference or the adjacent ends may contact each other). The shape of the plate is such that at least a sectional part, or a plurality of sectional parts, of the adjacent ends are inclined (at an arbitrary angle but including perpendicular) with respect to the rotational axis of the shaft, i.e. non-parallel to the rotational axis of the shaft. This inclination (preferably more than 30°) prevents a deformation of the collar during rotation of the shaft.

Preferably, the collar includes an engaging member (stopper) which allows for engagement with a mating engaging member provided on the shaft. The engaging members on the collar and on the shaft are preferably constituted such that relative rotational movement between the shaft and the collar is prevented. Alternatively or additionally, the engaging member allows fixing the position of the collar with respect to the shaft in the direction of the rotational axis. However, it is also possible to provide two different engaging members, one for fixing with respect to the rotational direction and one for fixing with respect to the axial direction. Preferably, the collar is integrally mounted on the shaft in order to avoid relative movements.

The shaft is preferably made of a non-metallic material, e.g. plastic, e.g. resin, etc. Preferably, the shaft is made of a material which has a hardness which is lower than the hardness of metal. Preferably, the collar is made of a material which has a hardness which is the same or higher than the hardness of metal. Preferably, the collar is made of metal. Preferably, the shaft is molded.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
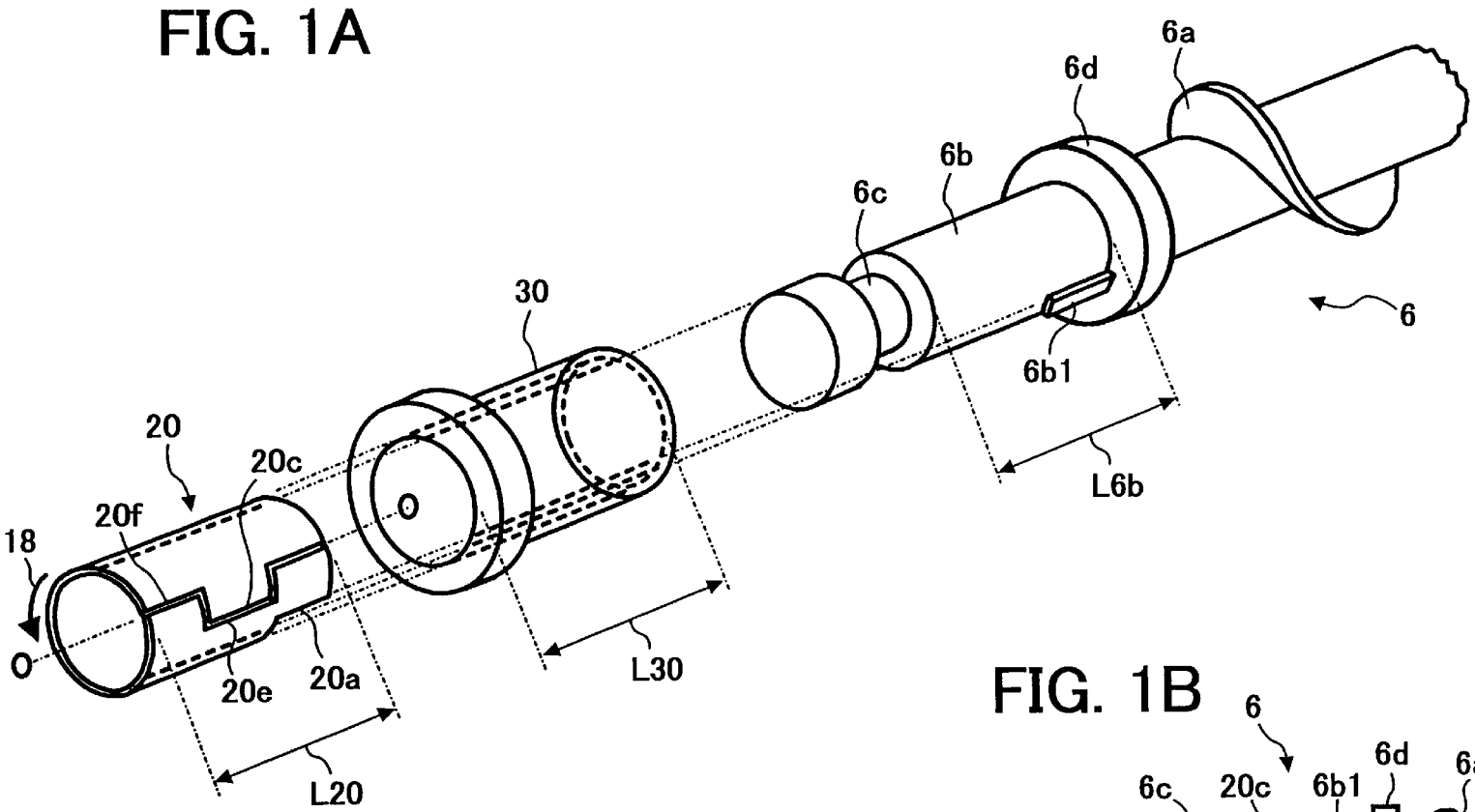
FIG. 1A is a perspective view illustrating a slide-rotating collar, a conveying screw, and a bearing.

Referring now to the drawings, wherein like reference numerals designate identical or corresponding parts throughout the several views, the present invention may widely be applied to a resin shaft rotating at a high speed. An example of the present invention is a developer conveying screw of a developing unit to be used in an image forming apparatus.

Firstly, a developing unit and an image forming apparatus is described below. Then, a rotating shaft and a slide-rotating collar is described.

[1] An example of an image forming apparatus.

Figure 4:
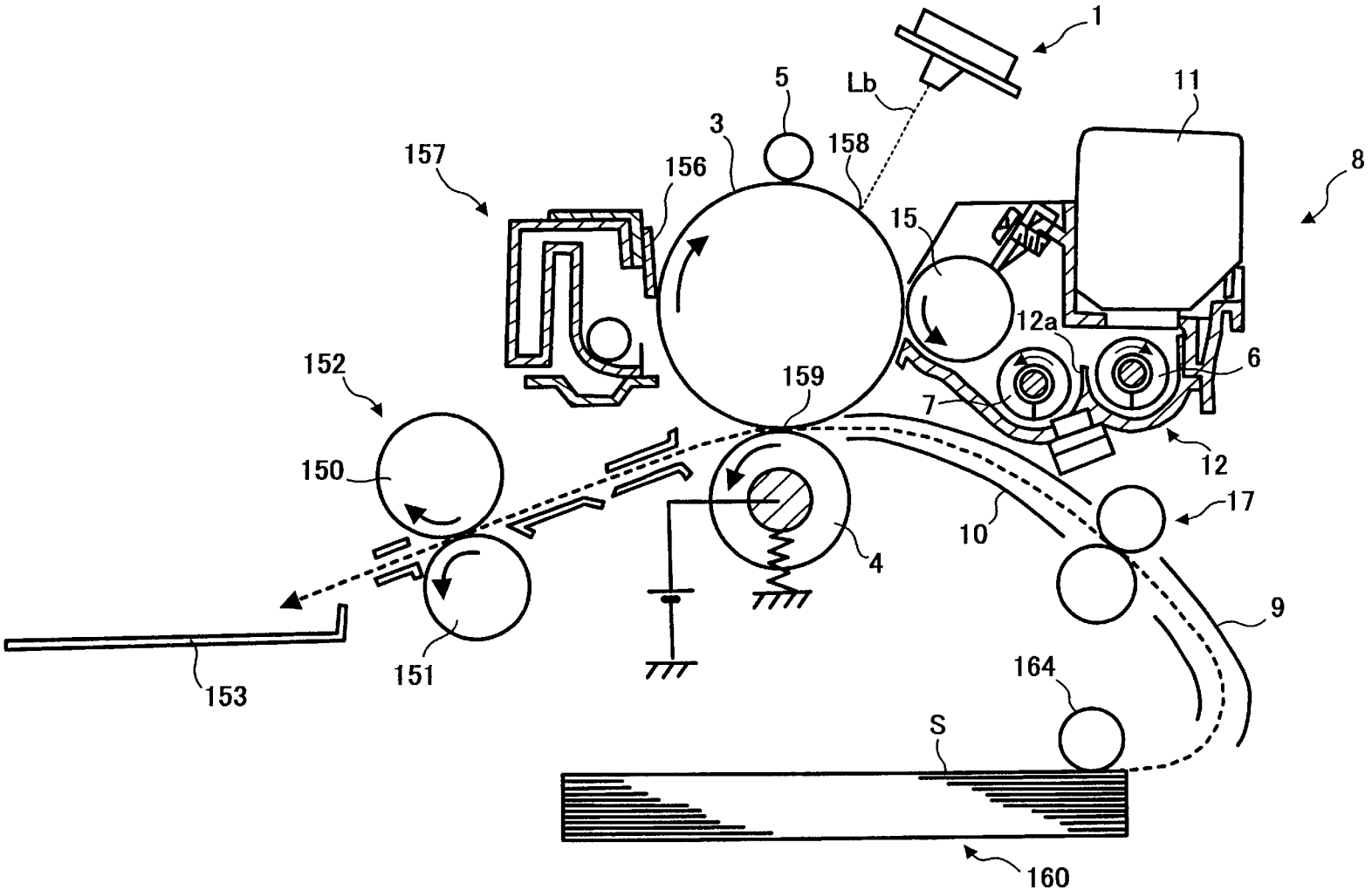
FIG. 4 is a schematic drawing illustrating an image forming apparatus using a developing device in which a resin shaft and the slide-rotating collar are employed.

An exemplary construction of an image forming apparatus is now described below. FIG. 4 is a cross-section illustrating major components of a digital image forming apparatus. In FIG. 4, an image bearing member 3 includes a drum-shaped rotating substrate and a photoconductive surface layer over the rotating substrate. The surface of the image bearing member 3 is scanned by an optical writing unit.

Around the image bearing member 3, a charging roller 5, an optical scanning unit 1, a developing unit 8, a conveying guide 10, and a cleaning unit 157 are disposed in order of a clockwise rotating direction of the image bearing member 3 as indicated by an arrow. The charging roller 5 and the optical scanning unit 1 serve as a charging device and optical writing device, respectively. The developing unit 8 includes a developing roller 15 and conveying screws 6 and 7. The conveying guide 10 guides a sheet-formed medium S on which an image is record. The cleaning unit 157 includes a blade 156 which is in sliding contact with the surface of the image bearing member 3.

The optical scanning unit 1 irradiates the surface of the image bearing member 3 (i.e., a position between the charging roller 5 and the developing roller 15) with beam light Lb. The beam light Lb is scanned in a main scanning direction which is parallel with a direction of a rotating shaft of the image bearing member 3. The position where the beam light Lb is irradiated is referred to as an exposed position 158. A transfer roller 4 is arranged beneath the image bearing member 3, which is a transfer device, in contact with the image bearing member 3. This contacting position is referred to as a transfer position (hereinafter referred to as a nip 159).

The transfer roller 4 is rotated by the rotation of the image bearing member 3 in a direction indicated by an arrow. A conveying guide 9 is provided from a sheet feeding unit 160 to a registration roller 17 to guide the conveyed sheet-formed medium S. Further, the conveying guide 10 is arranged from the registration roller 17 toward the nip 159. The conveying guides 9 and 10 include a upper and lower guide, respectively.

The sheet-formed medium S loaded in the sheet feeding unit 160 is discharged by a paper feeding roller 164, and is separated into one sheet by a separation mechanism (not shown). The medium S is conveyed to the conveying guide 9, the registration roller 17, the conveying guide 10, the nip 159, and a fixing unit 152. The medium S is then discharged to an exit tray 153. The path through which the sheet-formed medium S is conveyed is indicated in a dotted line in FIG. 4.

In this image forming apparatus, an image is formed as described below. The image bearing member 3 starts rotating and a surface of the image bearing member 3 is uniformly charged by the charging roller 5 in the dark while the image bearing member 3 is rotating. The beam light Lb scans the exposed position 158 which eliminates the charge applied thereto, thereby forming an electrostatic latent image corresponding to an image to be printed. The electrostatic latent image formed on the surface of the image bearing member 3 is moved to the developing unit 8 with the rotation of the image bearing member 3. The electrostatic latent image is then developed into a visible toner image by the developing unit 8.

The developing roller 15 of the developing unit 8 adheres toner of positive polarity to the electrostatic latent image formed on the surface of the image bearing member 3 to develop the electrostatic latent image. An image forming system according to an example of the present invention employs a so-called negative-positive development system in which the surface of the image bearing member 3 is negatively charged and toner of positive polarity is used.

After the above-described toner image is formed, the paper feeding roller 164 starts conveying the sheet-formed medium S with a predetermined timing. The sheet-formed medium S is conveyed to the registration rollers 17 through a conveying path indicated by a dotted line where the conveyance of the sheet-formed medium S is temporarily stopped. The registration roller 17 then conveys the sheet-formed medium S, thereby adjusting the timing.

The sheet-formed medium S conveyed from the registration roller 17 is fed to the nip 159. The toner image formed on the surface of the image bearing member 3 is transferred onto the sheet-formed medium S at the nip 159 by an electric field generated by the transfer roller 4.

The toner image transferred onto the sheet-formed medium S is fixed by fixing rollers 150 and 151 of the fixing unit 152. The sheet-formed medium S is then discharged to the exit tray 153.

Residual toner remaining on the surface of the image bearing member 3 without being transferred onto the sheet-formed medium S at the nip 159 is conveyed to the cleaning unit 157 by the rotation of the image bearing member 3. The residual toner is removed by the cleaning unit 157. The removed toner is used for the following image forming operations.

[2] An example of a developing device.

As described above, the developing unit 8 shown in FIG. 4 includes the developing roller 15 and the conveying screws 6 and 7. The shafts of the developing rollers 15 and the conveying screws 6 and 7 are longitudinally positioned in a direction perpendicular to the surface of the sheet-formed medium S.

A toner cartridge 11 is disposed above the conveying screw 7. The conveying screw 7 is located at a position where toner is gradually dropped from the toner cartridge 11 by a dropping device (not shown).

Hereinafter, the housing of the developing unit 8 is described with the reference numeral 12. The housing 12 includes bends and lower portions of the conveying screws 6 and 7 that are positioned in the respective bends of the housing 12. A boundary of the two bends is partitioned by a partition 12*a*. End portions of the two bends, which face each other in the direction of the length (i.e., front end and back end portions), are connected to each other. An approximately rectangular conveying path is formed, as viewed from the top.

Each of the shafts of the conveying screws 6 and 7, which are integral with each screw, are engaged with a gear (not shown) such that the conveying screw 7 rotates in a counterclockwise direction while the conveying screw 6 rotates in a clockwise direction.

In FIG. 4, when the conveying screw 6 conveys toner from the front end of the housing 12 toward the back end of thereof, the conveying screw 7 conveys the toner from the back end of the housing 12 toward the front end thereof. With this arrangement, toner is conveyed through the rectangular path while being stirred.

The toner being conveyed by the conveying screw 7 is electrostatically attracted to a magnetic brush formed by a carrier and toner on an outer peripheral surface of the developing roller 15 which includes a magnet inside. The magnetic brush is conveyed to the image bearing member 3 by rotation of the developing roller 15 to develop an electrostatic latent image formed on the surface of the image bearing member 3.

The rotational speed of the conveying screws 6 and 7 is approximately 300 rpm. Because the conveying screws 6 and 7 that are approximately identical in both shape and size, the description of the present invention will be made assuming that the conveying screw 6 corresponds to a rotating shaft of the present invention.

[3] An example of a conveying screw

Figure 1B:
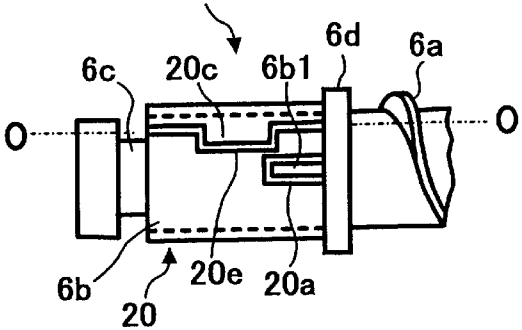
FIG. 1B is a schematic drawing illustrating the slide-rotating collar mounted on a shaft of the conveying screw.

The conveying screw 6 illustrated in FIGS. 1A and 1B is an exemplary construction of a rotating shaft according to an example of the present invention. The conveying screw 6 includes a screw 6*a,* a shaft 6*b,* and a groove 6*c* for an "E" ring. A stopper 6*d* having a large diameter is provided in a boundary between the screw 6*a* and the shaft 6*b*.

The screw 6*a,* the shaft 6*b,* the groove 6*c,* and the stopper 6*d,* which constitute the conveying screw 6, can be integrally molded from a resin to save weight and to reduce manufacturing costs by mass-production.

The reference numeral 20 represents a slide-rotating collar which includes a metallic plate bent in a round shape (hereinafter referred to as a collar). An axial length L20 of the collar 20 is equal to an axial length L6*b* of the shaft 6*b*.

A mild steel having 400 N/mm tensile strength and a thickness of between 0.1 mm and 0.5 mm can be used as a material for the collar 20. The material having the above-described thickness may not affect the size of the diameter of the shaft 6*b*.

Basically, the collar 20 is produced by cutting the above-described material into a rectangle which is then pressed into a round shape. The collar 20 is engaged with the shaft 6*b*. The stopper 6*d* stops the collar 20 when the collar 20 is engaged with the shaft 6*b*.

A projection 6*b*1, which is rectangle-shaped in the axial direction of the shaft 6*b,* is previously formed on a periphery surface of the shaft 6*b* as a stopper for the collar 20 in order to unite the collar 20 with the shaft 6*b*. A depression 20*a,* corresponding to the projection 6*b*1, is also previously formed on the collar 20 such that the projection 6*b*1 engages with the depression 20*a*.

Thus, when the collar 20 is mounted on the shaft 6*b,* the projection 6*b*1 is engaged with the depression 20*a*. The collar 20 then rotates integrally with the rotation of the shaft 6*b*. A generally known key mechanism can be used for the projection 6*b*1.

As described above, a slide-rotating collar is configured to rotate integrally with a shaft with a simple configuration.

The shaft 6*b,* on which the collar 20 is mounted, is engaged with a bearing 30 (see FIG. 1A), which is fixed to the housing 12 of the developing unit 8 (see FIG. 4). An "E" ring (not shown) is then attached to the groove 6*c* so that the shaft 6*b* does not come out of the bearing 30. Therefore, L30, which is an axial length of the bearing 30, is equal to the length of L6*b* and L20.

If both ends of the collar 20 facing each other in a circumferential direction align in a shaft line direction indicated by "0—0", each of the ends of the collar 20 may deviate in the axial direction resulting in a deformation of the end portions of the collar 20 when the collar 20 is mounted on the shaft 6*b*. Thus, a rectangular projected portion is formed at one end of the collar 20 while a rectangular recessed portion is formed at the other end thereof such that the both ends of the collar 20 do not face in line with the line of "0—0", as illustrated in FIGS. 1A and 1B. The projected portion and the recessed portion are indicated by the reference numerals of 20*c* and 20*e,* respectively.

The two ends of the collar may be made into a waveshape to face each other. This arrangement prevents a deformation of the collar 20 when the collar 20 is mounted on the shaft 6*b,* and also decreases a slide resistance because both ends of the collar 20 do not face each other by aligning in the shaft line direction but continuously face in the rotational direction of the collar 20.

Because the collar 20 is produced by bending a metallic plate, it can be sufficiently processed even though the metallic plate is thin. Further, it can be mass-produced. The outer diameter of the shaft 6*b* with the collar 20 mounted thereon does not become large because the collar 20 is thin. Thus, an increase of driving load caused by using a shaft having a larger diameter is avoided. An apparatus using this resin shaft is also kept to a minimum size. Production cost can be reduced because the apparatus can be mass-produced. Further, durability of the resin shaft increases because the resin shaft is protected by the collar.

When a projected portion and a recessed portion are formed at one end and at the other end of the collar 20 such that both ends of the collar 20 do not face in line with the shaft line "0—0", the projected portion 20*c* and the recessed portion 20*e* are positioned at a forward side of a facing line 20*f,* where the ends of the collar 20 face each other in a straight line, relative to the direction of rotation 18 of the screw 6. In other words, the outer edge of the projected portion 20*c* is positioned at the forward side of the projected portion 20*c* relative to the direction of rotation 18 of the screw 6.

With this arrangement, curling up of the projected portion 20*c* and the recessed portion 20*e* is prevented when the collar 20 rotates because the projected portion 20*c* and the recessed portion 20*e* are positioned in a so-called forward direction of the rotation of the collar 20. Sliding resistance is also decreased and smooth rotation of the collar 20 is maintained.

[4] An exemplary construction of a stopper for the collar 20.

EXAMPLE 1

According to the example illustrated in FIGS. 1A and 1B, the projection 6*b*1 and the depression 20*a* are provided in the sides of the shaft 6*b* and the collar 20, respectively. They serve as a stopper by engaging each other.

Figure 2A:
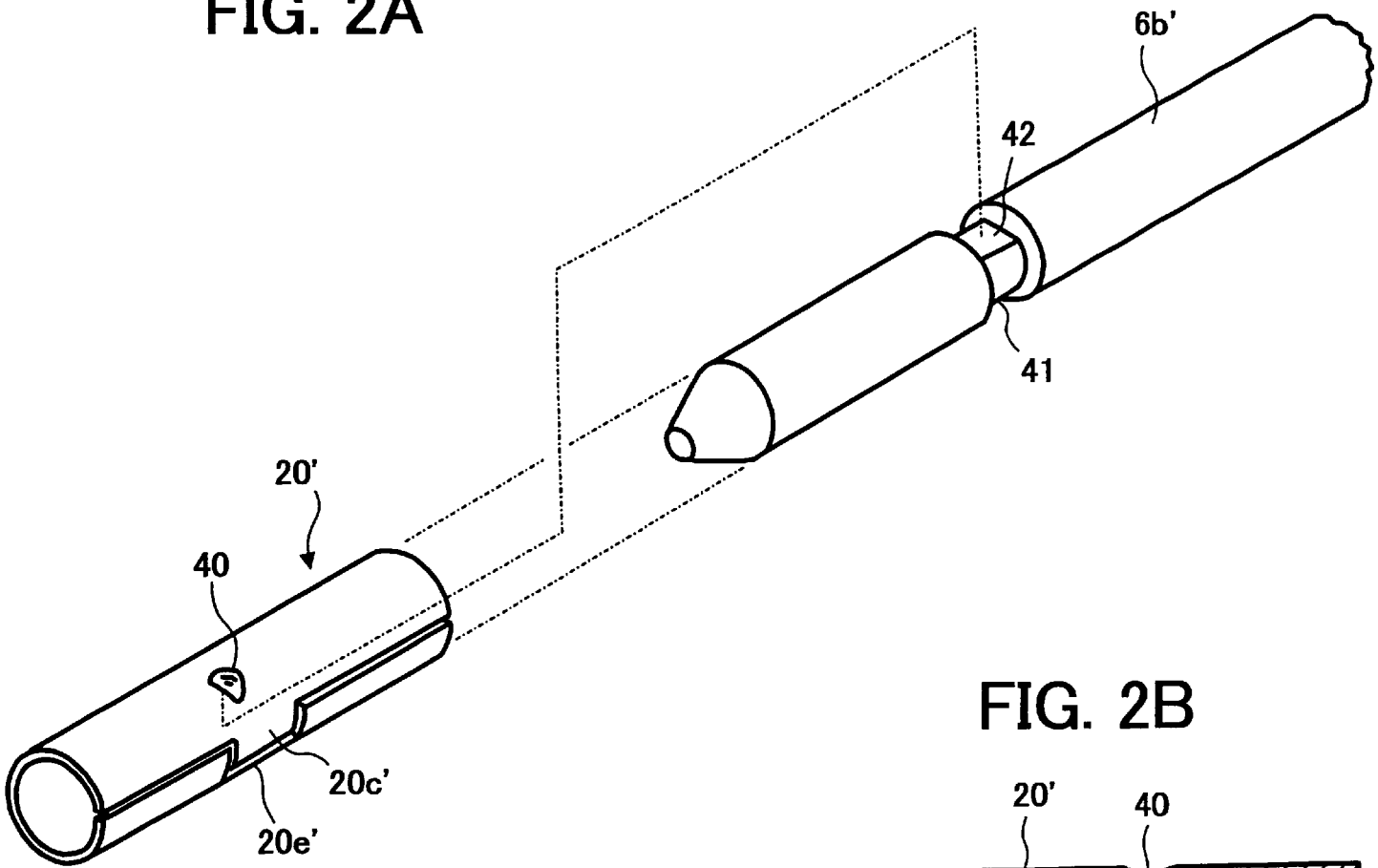
FIG. 2A is a perspective view illustrating the slide-rotating collar and the shaft of the conveying screw.
Figure 2B:
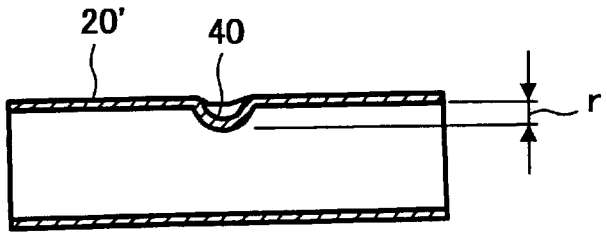
FIG. 2B is a sectional view illustrating the slide-rotating collar.

According to another example, FIGS. 2A and 2B illustrate a projection 40 having a radius (r) between 0.3 mm and 0.5 mm which is formed toward the inside of the collar 20' as a stopper in the side of the collar 20'. A ring-shaped groove 41 is formed on a shaft 6*b'* in a circumferential direction. A flat portion 42 is formed in the groove 41 as a stopper in the side of the shaft 6*b'*.

The collar 20' is produced in a manner similar to the collar 20 except for the projection 40. A projected portion 20*c'* and a recessed portion 20*e'* are formed at one end and at the other end of the collar 20', respectively.

According to the example, when the collar 20' is mounted on the shaft 6*b'*, the projection 40 elastically deforms such that it enters into the groove 41 and abuts against the flat portion 42. Thus, the position of the collar 20' along the length of the shaft 6*b'* is determined by an engagement of the projection 40 with the groove 41. The projection 40 serves as a stopper to stop a rotation of the collar 20' by abutting against the flat portion 42. Therefore, it is not necessary to provide a stopper, such as the stopper 6*d* in FIGS. 1A and 1B to determine a position of the collar 20' in an axial direction.

EXAMPLE 2

Figure 3A:
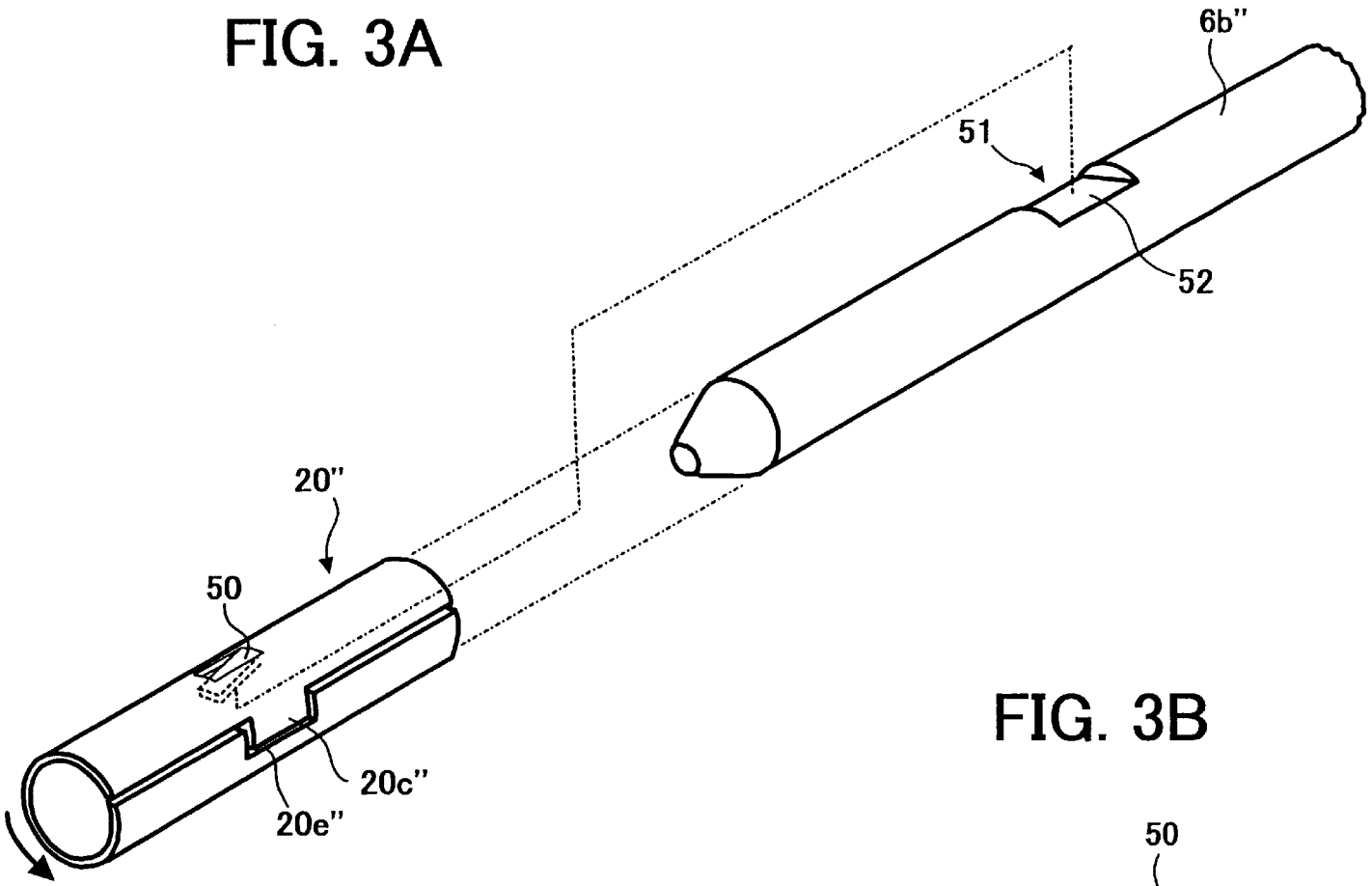
FIG. 3A is a perspective view illustrating the slide-rotating collar and the shaft of the conveying screw.
Figure 3B:
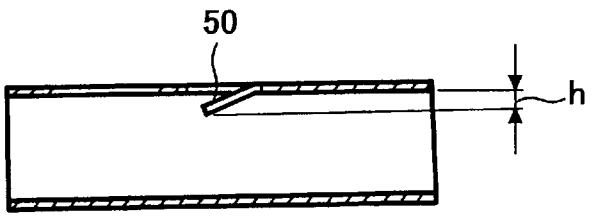
FIG. 3B is a sectional view illustrating the slide-rotating collar.

According to another example of the present invention, illustrated in FIGS. 3A and 3B, a projection 50 is formed as a stopper in the side of a collar 20" by cutting three edges of a rectangle and bending the cut portion of the rectangle toward the inside of the collar 20" by a height (h) between 0.3 mm and 0.5 mm. A groove 51 is formed on a shaft 6*b"*. The groove 51 includes a flat portion 52 which is a stopper in the side of the shaft 6*b"*.

The collar 20" is produced in a manner similar to the collar 20 except for the projection 50. A projected portion 20*c"* and a recessed portion 20e" are formed at one end and at the other end of the collar 20", respectively.

According to the example, when the collar 20" is mounted on the shaft 6*b"*, the projection 50 elastically deforms such that it enters into the groove 51 and abuts against the flat portion 52. Thus, a position of the collar 20" in the longer direction of the shaft 6*b"* is determined by an engagement of the projection 50 with the groove 51. The projection 50 serves as a stopper for a rotation of the collar 20" by abutting against the flat portion 52. According to the example, a stopper, such as the stopper 6*d* in FIGS. 1A and 1B to determine a position of the collar 20" in an axial direction, is not required because both ends of the groove 51 in the axial direction serve as a stopper to determine a position of the projection 50.

In the example 1, the dome-shaped projection 40 can be processed when stamping a metal plate into the collar 20'. In the example 2, the projection 50 can be processed when stamping a metal plate into the collar 20". In either of these two examples, two functions can be obtained simultaneously when a collar is mounted on a shaft. That is, one function is to stop the collar rotating with respect to the shaft, and the other function is to maintain a position of the collar in an axial direction.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-191170, filed on Jun. 26, 2000, and the entire contents thereof are herein incorporated by reference.

What is claimed as new and is desired to be secured by Letters Patent of the United States is:

1. A slide-rotating collar configured to be mounted on a shaft, said slide-rotating collar comprising:

a cylindrically bent metallic plate, wherein a first end of the metallic plate engageably faces a second end of the metallic plate, and wherein at least a sectional part of each of said first and second ends thereof is non-parallel with respect to a rotational axis of said shaft; and a first stopper configured to engage with a second stopper on the shaft to stop rotation of the slide-rotating collar with respect to the shaft.

2. A rotatable non-metallic shaft comprising:

a slide-rotating collar configured to be mounted on the shaft, said slide-rotating collar comprising:

a cylindrically bent metallic plate, wherein a first end of the metallic plate engageably faces a second end of the metallic plate, and wherein at least a sectional part of each of said first and second ends thereof is non-parallel with respect to a rotational axis of said shaft; and a first stopper configured to engage with a second stopper on the shaft to stop rotation of the slide-rotating collar with respect to the shaft wherein said slide-rotating collar is mounted on a portion of the shaft where the shaft engages with a bearing, where said bearing rotatably supports the shaft.

3. The rotatable non-metallic shaft according to claim 2, wherein said slide-rotating collar has a projected portion at the first end thereof and a recessed portion at the second end thereof, where said slide-rotating collar is mounted on the shaft such that an outer edge of the projected portion is positioned at a forward side of the projected portion relative to a direction of rotation of the shaft.

4. A developing device comprising the rotatable non-metallic shaft according to claim 3, further comprising a rotatable member configured to stir and convey a developer.

5. An image forming apparatus comprising the developing device according to claim 4, further comprising:

an image bearing member configured to form an electrostatic latent image on a surface thereof, wherein the developing device is configured to develop the electrostatic latent image into a visible image with a developer; and a transfer device configured to transfer the visible image onto a sheet-formed medium to obtain a recording image.

6. A rotatable non-metallic shaft comprising:

a slide-rotating collar configured to be mounted on the shaft, said slide-rotating collar comprising a cylindrically bent metallic plate, wherein a first end of the metallic plate engageably faces a second end of the metallic plate, and wherein at least a sectional part of each of said first and second ends thereof is non-parallel with respect to a rotational axis of said shaft, wherein said slide-rotating collar is mounted on a portion of the shaft where the shaft engages with a bearing, where said bearing rotatably supports the shaft.

7. The rotatable non-metallic shaft according to claim 6, wherein said slide-rotating collar has a projected portion at the first end thereof and a recessed portion at the second end thereof, where said slide-rotating collar is mounted on the shaft such that an outer edge of the projected portion is positioned at a forward side of the projected portion relative to a direction of rotation of the shaft.

8. A developing device comprising the rotatable non-metallic shaft according to claim 7, further comprising a rotatable member configured to stir and convey a developer.

9. An image forming apparatus comprising the developing device according to claim 8, further comprising:

an image bearing member configured to form an electrostatic latent image on a surface thereof, wherein the developing device is configured to develop the electrostatic latent image into a visible image with a developer; and a transfer device configured to transfer the visible image onto a sheet-formed medium to obtain a recording image.

10. A slide-rotating collar configured to be mounted on a shaft comprising:

a cylindrically bent metallic plate, wherein a first end of the metallic plate engageably faces a second end of the metallic plate, and wherein at least a sectional part of each of said first and second ends thereof is non-parallel with respect to a rotational axis of said shaft; and a first stopper means for stopping rotation of the slide-rotating collar with respect to the shaft by engaging with a second stopper means on the shaft.

11. A method for producing a slide-rotating collar comprising:

bending a metallic plate into a round shape such that a first end of the metallic plate engageably faces a second end of the metallic plate, at least a sectional part of each of said first and second ends thereof being inclined with respect to a rotational axis of said slide-rotating collar;

providing a stopper on a surface of the metallic plate; and forming a projected portion at the first end of the metallic plate and a recessed portion at the second end of the metallic plate such that an outer edge of the projected portion is positioned at a forward side of the projected portion relative to a direction of rotation of a shaft.

* * * * *